US010772380B2

(12) United States Patent
Singer

(10) Patent No.: US 10,772,380 B2
(45) Date of Patent: Sep. 15, 2020

(54) SHOE HEEL PLATFORM

(71) Applicant: Brooke A. Singer, Wexford, PA (US)

(72) Inventor: Brooke A. Singer, Wexford, PA (US)

( * ) Notice: Subject to any disclaimer, the term of this patent is extended or adjusted under 35 U.S.C. 154(b) by 460 days.

(21) Appl. No.: 14/931,127

(22) Filed: Nov. 3, 2015

(65) Prior Publication Data

US 2017/0119097 A1 May 4, 2017

(51) Int. Cl.
*A43B 13/28* (2006.01)

(52) U.S. Cl.
CPC ..... *A43B 13/28* (2013.01)

(58) Field of Classification Search
CPC ..... A43B 13/28; A43B 3/16; A43B 1/0054; A43C 13/12
USPC ..... 36/7.1 R, 72 R
See application file for complete search history.

(56) References Cited

U.S. PATENT DOCUMENTS 754,673 A * 3/1904 Mitchell ..... A43B 7/32 36/135
810,753 A * 1/1906 Hatfield ..... A43B 5/18 36/135
1,063,205 A * 6/1913 Leonard ..... A43B 5/18 36/7.5
1,350,197 A * 8/1920 Wood ..... A43C 13/12 36/7.5
2,128,134 A * 8/1938 Giusto ..... A43C 15/00 36/15
2,408,564 A * 10/1946 Lea ..... A43B 3/16 36/1
2,723,467 A * 11/1955 Cassidy ..... A43B 5/12 36/113
4,183,157 A * 1/1980 Counselman ..... A43B 5/185 36/135
4,498,252 A * 2/1985 Connors ..... A43B 5/007 36/72 B
5,311,675 A * 5/1994 Topel ..... A43B 21/00 36/72 B
5,666,746 A * 9/1997 Pollard ..... A43B 3/26 36/135
6,092,306 A * 7/2000 Newton-Dunn ..... A43B 5/12 36/135
6,598,317 B1 * 7/2003 Le Vine ..... A43B 5/12 36/15
8,307,571 B1 11/2012 Ceylan
2008/0148606 A1 * 6/2008 Brown ..... A43C 13/00 36/72 B (Continued)

OTHER PUBLICATIONS http://www.tanyaheath.com/en/changing-heels.html, as published Oct. 31, 2015.

*Primary Examiner* — Anne M Kozak

(57) ABSTRACT

A shoe heel platform includes a substantially flat base sized to extend under a heel of a high heeled shoe. The base includes a heel section with a connecting member positioned and configured to removably attach to the heel of the high heeled shoe. The connecting member may be a magnet, a receptacle to receive a tap piece of the heel of the shoe, or both. The base also may include a sole section with a connecting member positioned and configured to removably attach to the sole of the high heeled shoe. The base also may include a linking member that connects the heel section to the sole section in a manner that enables a user to adjust the size of the base.

18 Claims, 3 Drawing Sheets

(56) References Cited

U.S. PATENT DOCUMENTS

| | | | | |
|---|---|---|---|---|
| 2008/0196279 | A1* | 8/2008 | Epping | A43B 3/0078 36/72 B |
| 2012/0216428 | A1* | 8/2012 | Marandos | A43B 3/0078 36/130 |
| 2013/0139411 | A1* | 6/2013 | White | A43B 1/0027 36/136 |
| 2015/0101210 | A1* | 4/2015 | Jang | A43B 13/36 36/42 |
| 2016/0095386 | A1* | 4/2016 | Macfarlane | A43B 13/36 36/15 |

* cited by examiner

SHOE HEEL PLATFORM

BACKGROUND

High heels are ubiquitous on women's shoes, especially on shoes that are worn for special occasions such as weddings, formal dances, and nights on the town. The heels on shoes worn for special occasions are often higher than other heeled shoes, with heights of about 2 to about 6 inches or even more. This can make the act of walking while wearing high heeled shoes difficult. In addition, on special occasions such as weddings, school dances and other events women often wear the shoes while posing for pictures outdoors, often in grassy areas that provide little support for high heels. If the ground is soft or the heel is narrow, the heel can quickly sink into the ground, causing the woman to lose her balance, break the shoe's heel, or both.

This document describes methods and devices that are directed to solving at least some of the issues described above.

SUMMARY

In an embodiment, a shoe heel platform includes a base sized to extend from a sole of a high heeled shoe to a heel of the high heeled shoe. The base includes a first connecting member positioned and configured to removably attach to the sole of the high heeled shoe, along with a second connecting member positioned and configured to removably attach to the heel of the high heeled shoe. The base may include a heel section that is at least partially made of a rigid base material and that includes the second connecting member. The base also may include a sole section (also at least partially made of the rigid base material) that includes the first connecting member.

Optionally, the base may include a linking section that connects the sole and the heel section, and which is positioned to be placed under the shoe's upper. The linking section may be a flexible material. Alternatively, some or all of the linking section may be rigid, and the heel section, the sole section, or both may include a pocket sized and positioned to slidably receive the linking member.

The first connecting member (of the sole section) may include structures such as one or more of the following: a magnet; a hook-and-loop material; a receptacle sized and positioned to receive a member that extends from the sole of the shoe; or an extended member configured to be received by a receptacle in the sole of the high heeled shoe. In another option, the first connecting member comprises a pair of upwardly extending supports, each positioned at an opposing side of the sole section. Optionally, one or both of the upwardly extending supports may include a lateral extension, and the sole section may include one or more pockets, each positioned one of the sides of the sole section so that one of the lateral extensions slidably extends into the pocket.

The second connecting member (of the heel section) may include a magnet, or it may include a receptacle sized and positioned to receive and snugly fit around a tap piece of the heel of the high heeled shoe. The receptacle may be made of structures such as an elastic material, a rigid material having a non-smooth interior surface or a clasp. Optionally, some or all of the base may be transparent.

In another embodiment, a shoe heel platform includes a substantially flat base sized to extend at least from a sole of a high heeled shoe to a heel of the high heeled shoe. The base includes a sole section that has a first connecting member positioned and configured to removably attach to the sole of the high heeled shoe. The base also includes a heel section that has a second connecting member positioned and configured to removably attach to the heel of the high heeled shoe. An adjustable linking member connects the sole section and the linking section, and is positioned to be placed under an upper of the shoe.

Optionally, in this embodiment the heel section, the sole section or both may include a pocket sized and positioned to slidably receive the linking member. Also optionally, the linking member may integral with the sole section or the heel section. The other section (i.e., the section that is not integral with the linking member) may include a hinge or a pocket configured to receive the linking section.

In another embodiment, a shoe heel platform includes a substantially flat base sized to extend under a heel of a high heeled shoe. The base includes a heel section with a connecting member positioned and configured to removably attach to the heel of the high heeled shoe. The connecting member may include either or both of the following: a magnet, or a receptacle sized and positioned to receive and snugly fit around a tap piece of the heel of the high heeled shoe.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to."

This document will use the phrase "high heeled shoe" to refer to a shoe having a heel and tap piece that together are at least 1.5 inches (about 3.8 centimeters) high. An example of this will be discussed below.

Figure 1:
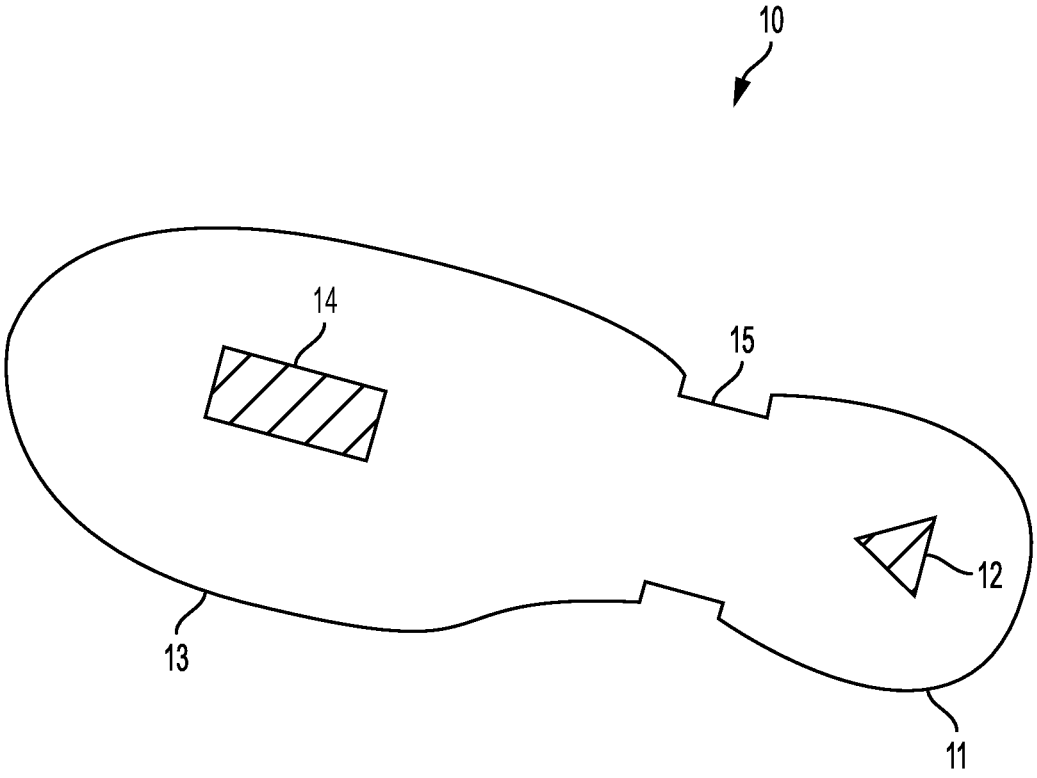
FIG. 1 illustrates an example of a shoe heel platform.

FIG. 1 illustrates an example of a shoe heel platform 10, which includes a base sized to extend from a sole of a high heeled shoe to a heel of the high heeled shoe. In the example shown, the base is made of a heel section 11, an optional sole section 13, and a linking section 15 that connects the heel section to the sole section. However, in other embodiments the base may consist of a single section (e.g., just a heel section having a width that is wider than that of the corresponding shoe's heel), a heel section and sole section with no intermediate section, or any number of joined sections. In addition, the heel section 11 and sole section 13 may be separate components with no linking section required.

The heel section 11 is made of one or more rigid materials. As used in this document, the term "rigid" does not mean entirely inflexible, but rather firm enough to provide support for the heel. Examples include plastic, solid rubber, PU (i.e., synthetic leather) and other materials such as those materials that are commonly used in shoe soles. The sole section 13 also may be made of a rigid material. If so, the linking section 15 may be made of a flexible material such as fabric, flexible plastic or leather so that the heel section may be folded over the sole section for storage. Alternatively, the linking section 15 may also be made of a rigid material and connected to the sole section 13 and heel section 11 by hinges or other structures, optionally with a locking mechanism to enable the linking section lock in a fixed position to provide additional support when in use. In some embodiments, the sole section 13 also may be made of a flexible material, although embodiments where the sole section is made of a rigid material may provide more support for the shoe.

Optionally, any or all of the components of the base may be made of a transparent material, of a material having a color that matches the color of the shoe, or of any other color. The base may be relatively thin and substantially flat (i.e., on a single plane, except for its connecting structures) so that it has a low profile and does not interfere with the aesthetic features of the shoe when viewed from the side. Thus, the base may not extend upward into the upper section of the shoe.

While FIG. 1 illustrates a base that is in the shape of a shoe sole, other shapes such as rectangles, rounded rectangles, ovals and other shapes may be used so long as the heel portion has length and width dimensions that are larger than that of the tap piece of the heel of a corresponding high heeled shoe. Thus, the larger size provides support for the heel and serves as a platform to support the heel.

The sole section 13 includes a first connecting member 14 positioned and configured to removably attach to the sole of the high heeled shoe, while the heel section 11 includes a second connecting member 12 positioned and configured to removably attach to the heel of the heeled shoe.

Figure 2:
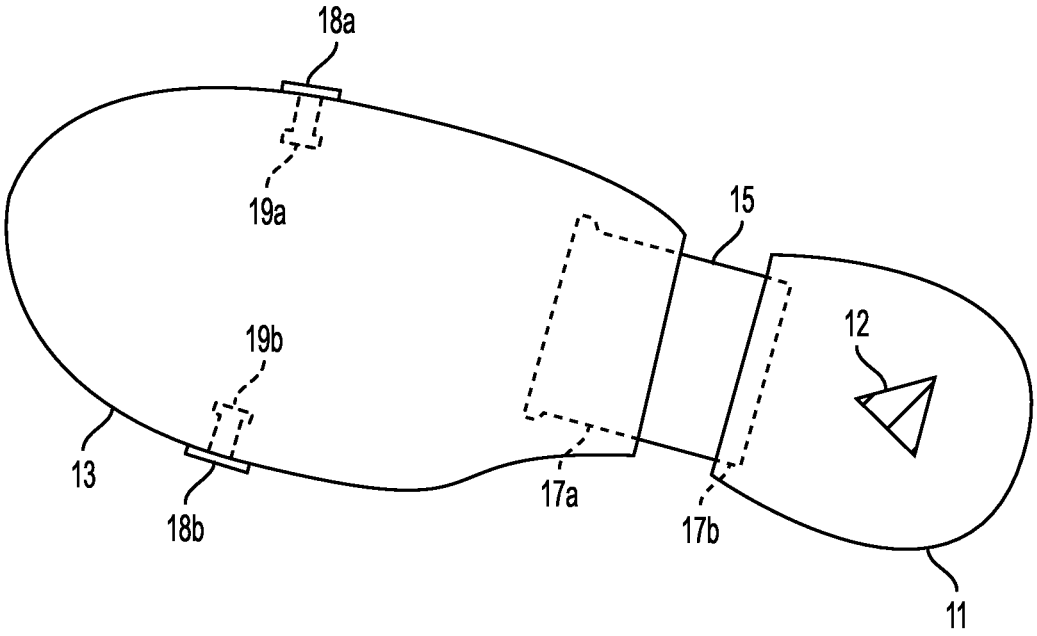
FIG. 2 illustrates a variation of the shoe heel platform of FIG. 1.

FIG. 2 illustrates a variation of the shoe heel platform 10 with certain alternate components. In practice, the shoe heel platform may include components shown in FIG. 1, components shown in FIG. 2, or a combination of components shown in FIGS. 1 and 2. In FIG. 2, the linking member 15 extends into a pocket 17*a* of the sole section 13 and into a pocket 17*b* of the heel section 11. In this way, the linking member may be fully extended into the pockets 17*a*, 17*b*, or the linking member 15 may be pulled partially out of either or both pockets 17*a*, 17*b* to allow the user to adjust the length of the platform to fit the wearer's shoe. Optionally, either or both ends of the linking member 15 may include a stop that is wider than the rest of the linking member and wider than the opening of the end's corresponding pocket to impede the linking member from sliding out of the pocket. Optionally, only one of the heel section 11 or the sole section 13 may include the pocket, and the other member may be attached to the linking member 15 by a hinge or fixed support. In other embodiments, the heel section 11 or the sole section 13 may be integral with the linking member 15, or either section may include the linking member 15 as a portion so that they are integrally formed as a single piece.

FIG. 2 also illustrates a variation of the sole section 13 in which instead of (or in addition to) a central connecting member the sole section 13 provides its connecting member in the form of a pair of side supports 18*a*, 18*b*, which extend upward from the widest point along the sides of the sole section 13. Each side support may include a clip, an inward slope, a friction surface made of a material such as rubber or a ribbed structure, or another surface to help the side support remain in place when attached to the shoe. Optionally, either or both of the side supports also may include a lateral extension 19*a*, 19*b* that slidably extends into a pocket of the sole section to allow the user to adjust the width of the sole section to accommodate shoes of varying widths. Rather than facing upward, the lateral extension will extend along the plane of the sole section. Optionally, the end of each lateral extension 19*a*, 19*b* may include a stop that is wider than the opening of the extension, and wider than the opening of extension's corresponding pocket, to impede the lateral extension from sliding out of the pocket.

Figure 3:
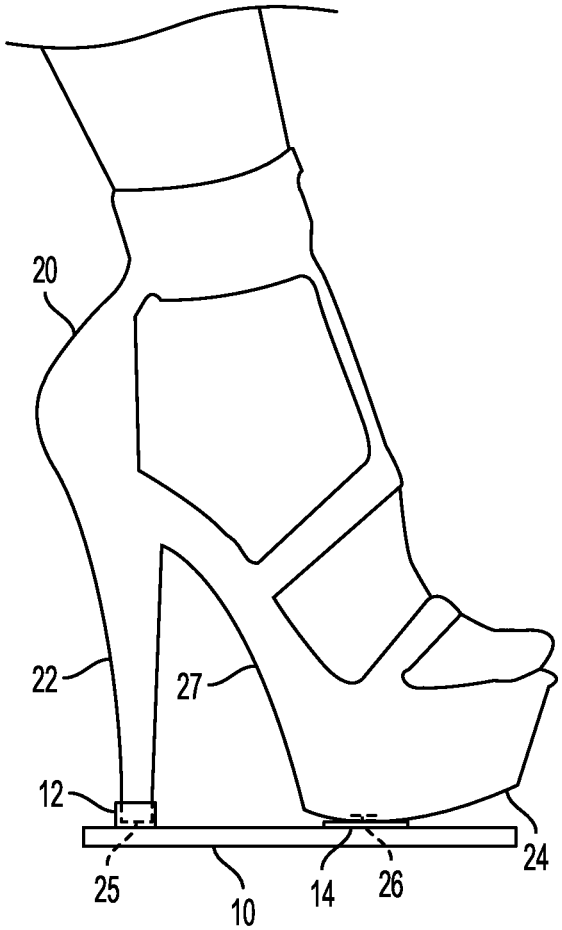
FIG. 3 illustrates an example of a high heeled shoe to which a shoe heel platform is removably attached.

FIG. 3 illustrates various embodiments of the platform 10 attached to a high heeled shoe 20. As shown, the shoe includes a heel 22 that includes a tap piece 25 at its lower end, a sole 24 positioned under the ball of the wearer's foot, and an upper 27 that extends between the heel 22 and the sole 24. The first connecting member 14 is attached to the sole 24 of the shoe, while the second connecting member 12 is attached to the heel 22, and in particular the heel's tap piece 25, of the shoe. The linking section, when provided, may be positioned under the upper 27 of the shoe. FIG. 3 also illustrates that the components of the platform may be substantially flat, along a single plane, to help provide support.

The first connecting member 14 may be made of any material or structure that is configured to removably connect to a corresponding connecting element 26 of the sole of the shoe. For example, the first connecting member 14 and the corresponding connecting element 26 may each include magnets positioned so that a first pole (positive or negative) of the second connecting element 26 faces downward from the shoe and the opposite pole (negative or positive) of the first connecting member 14 faces upward from the base 10. Alternatively or in addition, the first connecting member 14 and the corresponding connecting element 26 may each include a hook-and-loop material such as VELCRO®. Alternatively, the first connecting member 14 and the corresponding connecting element 26 may be a knob, hook or other member that extends from the bottom of the sole of the shoe, and the first connecting member 14 may be a receptacle sized and positioned to receive the extended member. As another alternative, the first connecting member 14 may be a knob, hook or other member that extends upward from the base, while the corresponding connecting element 26 may be a receptacle sized and positioned to receive the extended member. As another alternative, the first connecting member 14 may be a pair of upwardly extending side supports as shown in FIG. 2.

The second connecting member 12 may be made of any material or structure that is configured to removably connect to the heel 22 of the shoe. For example, the second connecting member 12 and may include a magnet, and the tap piece 25 or another portion of the heel 22 may also include a magnet, and each magnet may be positioned so that a first pole (positive or negative) of the heel's magnet faces downward from the shoe and the opposite pole (negative or positive) of the second connecting member 12 faces upward from the base. Alternatively, the second connecting member 12 may include receptacle sized and positioned to receive and snugly fit around a tap piece 25 and optionally other elements of the heel 22 of the shoe. When the second connecting member 12 is a receptacle, it may have a rigid housing and an interior with non-smooth sidewalls to provide a friction fit around the heel. In some embodiments, the second connecting member 12 may have an elastic housing that can expand for application but retract to hold the heel in place, or it may have other components designed to engage the heel. In other embodiments, the second connecting member 12 may include a clasp that can open to receive the heel and close around the heel while being secured by a spring, locking mechanism or other structure. Other configurations are possible.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. A shoe heel platform, comprising:

a base sized to extend from a sole of a high heeled shoe to a heel of the high heeled shoe, the base comprising:

a sole section that comprises a rigid base material and a first connecting member that is positioned and configured to removably attach to the sole of the high heeled shoe; and a heel section that comprises the rigid base material and that also comprises a second connecting member positioned and configured to removably attach to the heel of the high heeled shoe, wherein:

the second connecting member comprises a receptacle sized and positioned to receive and snugly fit around a tap piece of the heel of the high heeled shoe, and the receptacle comprises an elastic material or a rigid material having a non-smooth interior surface; and a linking member that connects the sole and the heel section that is adjustable in a longitudinal direction.

2. The shoe heel platform of claim 1, wherein the linking member comprises a flexible material.

3. The shoe heel platform of claim 1, wherein:

the linking member is positioned to be placed under an upper of the shoe without contacting the shoe; and the heel section, the sole section, or both include a pocket sized and positioned to slidably receive the linking member.

4. The shoe heel platform of claim 1, wherein the first connecting member comprises one or more of the following:

a magnet; or a hook-and-loop material.

5. The shoe heel platform of claim 1, wherein the first connecting member comprises a pair of upwardly extending supports, each positioned at an opposing side of the sole section.

6. The shoe heel platform of claim 5, wherein:

the sole section includes one or more pockets, each positioned on one of the sides of the sole section; and one or more of the upwardly extending supports includes a lateral extension sized and positioned to slidably extend into one of the pockets of the sole section.

7. The shoe heel platform of claim 1, wherein the second connecting member further comprises a magnet.

8. The shoe heel platform of claim 1, wherein the first connecting member comprises one or more of the following:

a receptacle sized and positioned to receive a member that extends from the sole of the high heeled shoe; or an extended member configured to be received by a receptacle in the sole of the high heeled shoe.

9. A shoe heel platform, comprising:

a substantially flat base sized to extend from a sole of a high heeled shoe to a heel of the high heeled shoe, the base comprising:

a sole section comprising a rigid base material, a heel section comprising the rigid base material, and an adjustable linking member that connects the sole section and the heel section, and which is positioned to be placed under an upper of the shoe and that is adjustable in a longitudinal direction;

a first connecting member attached to the sole section and positioned and configured to removably attach to the sole of the high heeled shoe; and a second connecting member attached to the heel section and that comprises a receptacle sized and positioned to receive, removably attach to, and snugly fit around a tap piece of the heel of the high heeled shoe, wherein the receptacle comprises an elastic material or a rigid material having a non-smooth interior surface.

10. The shoe heel platform of claim 9, wherein the heel section, the sole section, or both include a pocket sized and positioned to slidably receive the linking member.

11. The shoe heel platform of claim 9, wherein:

the linking member is integral with one of the sole section or the heel section; and the other of the sole section or the heel section includes a hinge or a pocket configured to receive the linking section.

12. The shoe heel platform of claim 9, wherein the first connecting member comprises one or more of the following:

a magnet; or a hook-and-loop material.

13. The shoe heel platform of claim 9, wherein the first connecting member comprises a pair of upwardly extending supports, each positioned at an opposing side of the sole section.

14. The shoe heel platform of claim 13, wherein:

the sole section includes one or more pockets, each positioned one of the sides of the sole section; and one or more of the upwardly extending supports includes a lateral extension sized and positioned to slidably extend into one of the pockets of the sole section.

15. The shoe heel platform of claim 9, wherein the second connecting member further comprises a magnet.

16. The shoe heel platform of claim 9, wherein the first connecting member comprises one or more of the following:

a receptacle sized and positioned to receive a member that extends from the sole of the high heeled shoe; or an extended member configured to be received by a receptacle in the sole of the high heeled shoe.

17. The shoe heel platform of claim 9, wherein the receptacle comprises an interior with non-smooth sidewalls to provide a friction fit around the heel.

18. A shoe heel platform, comprising:

a substantially flat base sized to extend under a heel and sole of a high heeled shoe, wherein the base comprises:

a heel section comprising a rigid base material and that is configured to be wider than a tap piece of the heel of the high heeled shoe, and a sole section comprising the rigid base material and that is positioned and configured to removably attach to the sole of the high heeled shoe a linking member that connects the sole and the heel section and that is adjustable in a longitudinal direction, and a connecting member that is positioned on the heel section and configured to removably attach to the heel of the high heeled shoe, wherein the connecting member comprises one or both of the following:

a magnet, or a receptacle sized and positioned to receive and snugly fit around the tap piece of the heel of the high heeled shoe, wherein the receptacle comprises an elastic material or a rigid material having a non-smooth interior surface.

* * * * *